US007066297B2

(12) United States Patent
Goodman et al.

(10) Patent No.: US 7,066,297 B2
(45) **Date of Patent: *Jun. 27, 2006**

(54) AUTOMATIC DOOR AND METHOD OF OPERATING SAME

(75) Inventors: E. Carl Goodman, Bountiful, UT (US); D. George Field, Pleasant Grove, UT (US); Kevin D. Banta, Highland, UT (US); John G. Garrett, Magna, UT (US)

(73) Assignee: Won-Door Corporation, Salt Lake City, UT (US)

( * ) Notice: Subject to any disclaimer, the term of this patent is extended or adjusted under 35 U.S.C. 154(b) by 90 days.

This patent is subject to a terminal disclaimer.

(21) Appl. No.: 10/703,315

(22) Filed: Nov. 7, 2003

(65) Prior Publication Data

US 2004/0094275 A1 May 20, 2004

Related U.S. Application Data

(63) Continuation of application No. 10/079,654, filed on Feb. 20, 2002, now Pat. No. 6,662,848.

(51) Int. Cl.
*E04G 3/00* (2006.01)

(52) U.S. Cl. ..... 182/84.02; 49/27; 160/84.11; 160/84.09

(58) Field of Classification Search ..... 160/84.02, 160/84.09, 84.11, 1, 7, 37, 188, 405; 49/27; 318/280

See application file for complete search history.

(56) References Cited

U.S. PATENT DOCUMENTS

| | | | |
|---|---|---|---|
| 4,834,161 | A | 5/1989 | Johnson et al. |
| 4,924,929 | A | 5/1990 | Johnson et al. |
| 5,581,944 | A | 12/1996 | Kornbrekke et al. |
| 5,605,185 | A | 2/1997 | McKeon |
| 5,625,266 | A | 4/1997 | Stark |
| 5,638,639 | A | 6/1997 | Goodman et al. |
| 5,696,362 | A | 12/1997 | Amend |

(Continued)

OTHER PUBLICATIONS

International Search Report for International Application No. PCT/US03/04848, mailed Jun. 25, 2003 (3 pages).

*Primary Examiner*—Bruce A. Lev
(74) *Attorney, Agent, or Firm*—TraskBritt

(57) ABSTRACT

An automatic door and method of operating the same. The door includes a first processor which may be located proximate a leading movable edge of the door and a second processor which is remotely located from the first processor. The first and second processors are operably coupled with a bus configured to transmit digital signals therebetween. One or more input devices may be coupled with the first processor to indicate the status of an operational parameter of the door. Operational parameters are transmitted to the second processor, which controls a drive operably coupled with the door to control the position thereof in response to such operational parameters. The second processor is configured such that, upon breakdown of communication between the first and second processors, the second processor causes the door to enter into a predetermined status.

17 Claims, 10 Drawing Sheets

U.S. PATENT DOCUMENTS 5,770,934 A 6/1998 Theile
5,789,887 A 8/1998 Elischewski
5,812,391 A 9/1998 Mehalshick
5,839,766 A 11/1998 Iannuzzi et al.
5,982,125 A 11/1999 Ranaudo et al.
6,075,333 A 6/2000 Huddle
6,225,768 B1 5/2001 Cookson et al.
6,243,006 B1 6/2001 Rejc et al.
6,286,258 B1 9/2001 Bischof et al.
6,304,968 B1 * 10/2001 Hacker et al. ..... 713/153
6,313,594 B1 11/2001 Janutta
6,662,848 B1 * 12/2003 Goodman et al. ..... 160/84.02
2002/0027184 A1 * 3/2002 Kovach et al. ..... 248/262
2002/0104266 A1 * 8/2002 Ranaudo ..... 49/334
2003/0000653 A1 * 1/2003 Ulatowski et al. ..... 160/84.02
2003/0221792 A1 * 12/2003 Schulte ..... 160/1
2004/0066277 A1 * 4/2004 Murray et al. ..... 340/5.54
2004/0069419 A1 * 4/2004 Becker et al. ..... 160/188

* cited by examiner

AUTOMATIC DOOR AND METHOD OF OPERATING SAME

CROSS-REFERENCE TO RELATED APPLICATION

This application is a continuation of application Ser. No. 10/079,654, filed Feb. 20, 2002, now U.S. Pat. No. 6,662,848, issued Dec. 16, 2003.

BACKGROUND OF THE INVENTION

1. Field of the Invention

The present invention relates generally to the control of automatic doors and, more specifically, to security-type doors including fire doors and systems utilized in the control of such doors.

2. State of the Art

Automatic doors are implemented in various configurations such as, for example, sliding doors, rotating panel doors, folding doors, and revolving doors. Automatic doors are often relied on for security and fire safety purposes. For example, referring to FIG. 1, an automatic door system 100 including one or more accordion-type doors 102A and 102B may be used as a security and/or a fire door. The doors 102A and 102B shown are formed with a plurality of panels 104 which are connected to one another with hinge-like members 106. The hinged connection of the panels 104 allows the doors 102A and 102B to be compactly stored in pockets 108 formed in the walls 110 of a building when in a retracted or folded state. When the doors are required to secure an area, such as an elevator lobby 112 during a fire, the doors 102A and 102B are driven by a motor (not shown) along a track 114 in order to provide an appropriate barrier.

As shown in FIGS. 1 and 2, two doors 102A and 102B may be utilized wherein each extends from its associated pocket 108 to cooperatively mate with one another. Referring to FIG. 2, a cross-sectional view is shown of two doors 102A and 102B (shown in a folded state and recessed in pockets 108) also referred to as a bi-part configuration. The first door 102A includes a male lead post 116 which is configured to cooperatively mate with the female lead post 118 of the second door 102B when each door is properly extended.

Alternatively, the automatic door system 100 may comprise a single door which mates with a stationary structure to form a barrier. As shown in FIG. 3, a single door 102A may include a male lead post 116 which is configured to mate with a female door post 118' formed in a wall 110.

As can also be seen in FIG. 3, an accordion-type door 102A may include a first accordion-style partition 119A and a second accordion-style partition 119B which is laterally spaced from and substantially parallel with the first partition 119A. Each of the two partitions 119A and 119B has a first end 120 structurally fixed to a floating jamb 121 which is movable within the pocket 108 and a second end 122 which is attached to the male lead post 116. Such a configuration is often utilized as a fire door wherein one partition 119A acts as a primary fire and smoke barrier, the space 124 between the two partitions 119A and 119B acts as an insulator or a buffer zone, and the second partition 119B acts as a secondary fire and smoke barrier.

The automatic door system 100 may further include various sensors and switches to assist in the control of the doors 102A and 102B. For example, as shown in FIG. 1, either of the doors 102A and 102B (or possibly both), when used as a fire door, may include a switch or actuator 126 commonly referred to as "panic hardware." Actuation of the panic hardware 126 allows a person located on one side of the doors 102A and 102B to cause the door(s) to open if they are closed, or to stop while they are closing, allowing access through the barrier formed by the door(s) for a predetermined amount of time.

The switches, sensors or other actuators associated with the doors 102A and 102B are typically electrically configured to operate as a normally open circuit or a normally closed circuit. Thus, for example, the panic hardware 126 may include a normally open-type switch which, when actuated, closes to form a circuit, thereby causing the door motor to behave in a predetermined manner. Similarly, a switch or sensor may be formed as a closed circuit which, upon actuation, opens the circuit, indicating that a certain event has happened and thereby invoking a response by the door motor. Conventionally, each circuit is dedicated, or specifically associated with a given sensor switch or actuator. These circuits are typically formed using multiple conductors which are connected, at one end, to respective switches, sensors and actuators, which are located at various positions on the doors 102A and 102B, and to the drive controller at their opposing ends. The conductors are conventionally configured to extend substantially the length of the door and are located between the partitions 119A and 119B. For example, FIG. 3 shows a cable 128 located in the space 124 between the partitions 119A and 119B. Such a cable 128 is conventionally configured to carry multiple conductors for connection with various switches and sensors.

The use of conductors to form circuits between a controller and various switches and sensors, while functionally adequate in certain environments, may cause the door to malfunction in various situations. For example, in fire doors, the insulation formed about the cables and conductors may melt when subjected to elevated temperatures, causing the conductors to short. When shorting occurs among one or more of the conductors, a change in a given circuit may occur. For example, the shorting of a given conductor may be seen by the door motor as the closing or opening of a circuit associated with that conductor. Thus, the door motor, responding to what it perceives as a change in a given circuit, causes the door to open or perform some other function when, in fact, the door should have continued in its previous state of operation.

The possibility of an automatic door malfunctioning in the above-described manner may result in the door failing to pass stringent codes or specifications for a given installation. More importantly, when such a malfunction occurs in a fire door, it may allow the spread of a fire, essentially obviating the presence of the fire door.

In view of the shortcomings in the art, it would be advantageous to provide an automatic door and a method of operating such a door which prevents the potential malfunction of the door in certain environments such as exposure to elevated temperatures. It would further be advantageous to be able to retrofit existing doors through simple modifications so as to also prevent such potential malfunctions.

BRIEF SUMMARY OF THE INVENTION

In accordance with one aspect of the invention, an automatic door is provided. The automatic door includes a first partition and a second partition, each being defined to include a first end and a second end. The second partition is laterally positioned from the first partition, forming a space therebetween. A leading edge is coupled with the first end of each partition. A first processor is disposed between the two partitions at a location proximate the leading edge of the door. A second processor is remotely located from the first processor, such as, for example, proximate the second ends of the partitions. A bus, configured to transmit digital signals, is coupled between the first and second processors. The second processor is coupled with a drive which is configured to control the position of the door's leading edge.

The automatic door may further include one or more input devices such as, for example, sensors, switches, actuators, as well as output devices such as actuators and audible and/or visual indicators associated with the operation of the door. Such input and output devices may be coupled with the first processor, which is configured to communicate their status to the second processor for control of the drive. For example, a sensor may be used to detect an obstruction in the path of the door. Upon sensing such an obstruction, the sensor may communicate with the first processor, which then sends a digital signal to the second processor indicative of the sensor's communication. The second processor may then send an operating signal to the drive to behave in a specified manner based on the sensor's communication.

The automatic door includes various configurations. One example includes a folding accordion-style door which is configured as a fire door. Such a door may include multiple panels coupled in a hinge-like manner and configured to extend and retract along a specified path.

In accordance with another aspect of the present invention, a method is provided for operating an automatic door. The method includes disposing a first processor adjacent a leading edge of a door such that the processor is moveable therewith upon the opening and closing of the door. A second processor is remotely located from the first processor and may be, for example, proximate an opposing end of the door. The first processor and second processor are coupled with one another by way of a digital bus. A signal is transmitted from the second processor to the first processor. Upon failure to acknowledge receipt of the signal by the first processor, the second processor causes the leading edge of the door to move to a predetermined position.

The method may further include providing input devices, such as, for example, switches or sensors, and transmitting signals from the input devices to the first processor, the signals being indicative of the status of the switches or sensors. The status of such input devices may then be transmitted from the first processor to the second processor for appropriate control of the drive.

The method may also include ignoring additional perceived data transmitted through the digital bus after the first processor has failed to acknowledge the receipt of the signal transmitted from the second processor. By ignoring additional perceived data, the second processor will not erroneously respond to false data transmitted over the bus due to the failure thereof.

BRIEF DESCRIPTION OF THE SEVERAL VIEWS OF THE DRAWINGS

The foregoing and other advantages of the invention will become apparent upon reading the following detailed description and upon reference to the drawings in which.

DETAILED DESCRIPTION OF THE INVENTION

Figure 1:
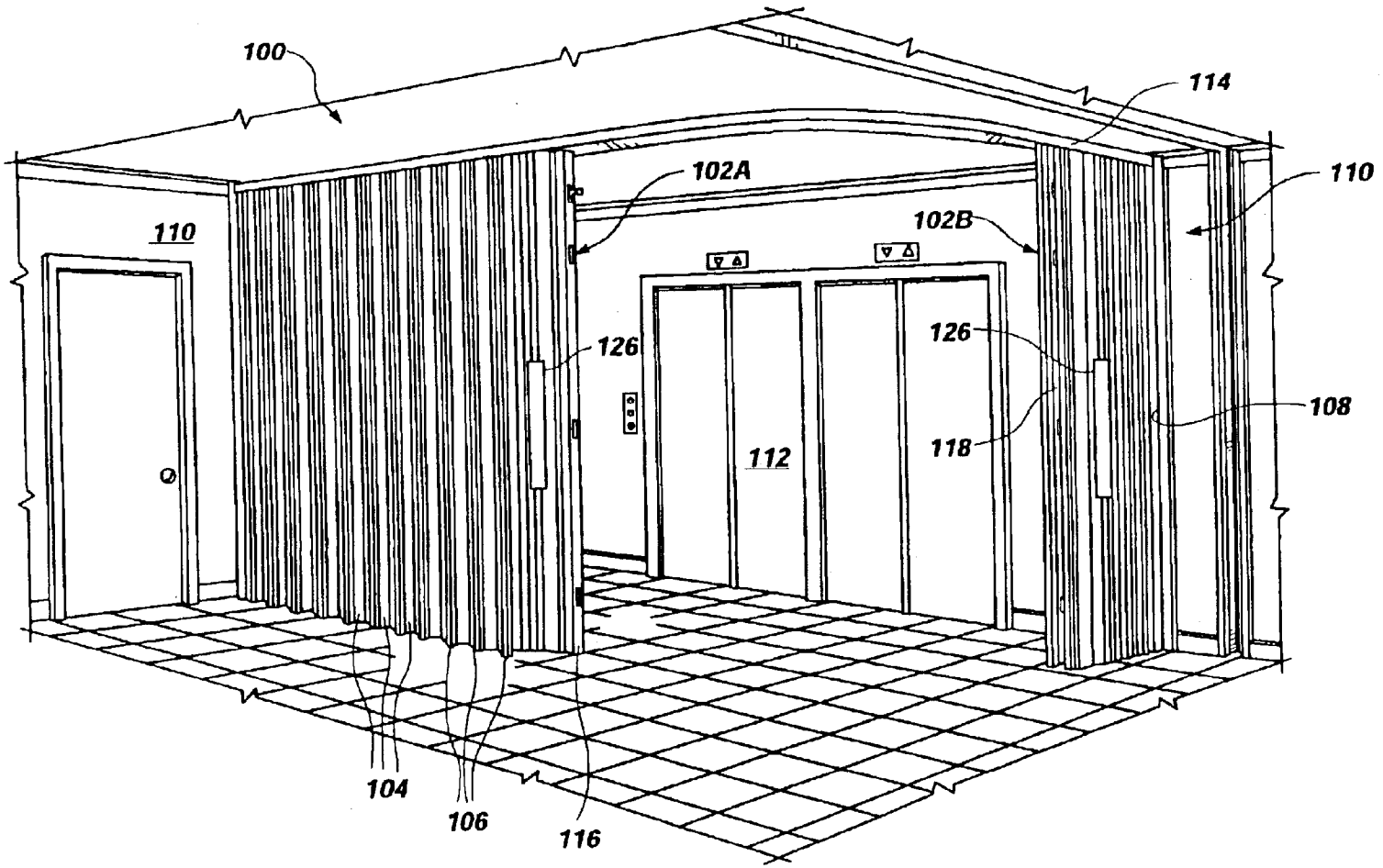
Fig. 1 (PRIOR ART)
FIG. 1 is a perspective view of a prior art automatic door.
Figure 2:
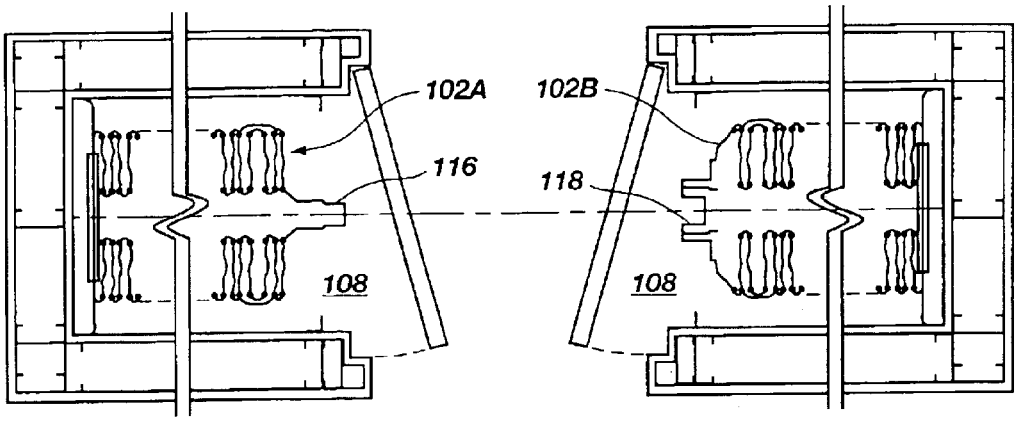
Fig. 2 (PRIOR ART)
FIG. 2 is a partial cross-sectional view taken of one embodiment of a prior art automatic door.
Figure 3:
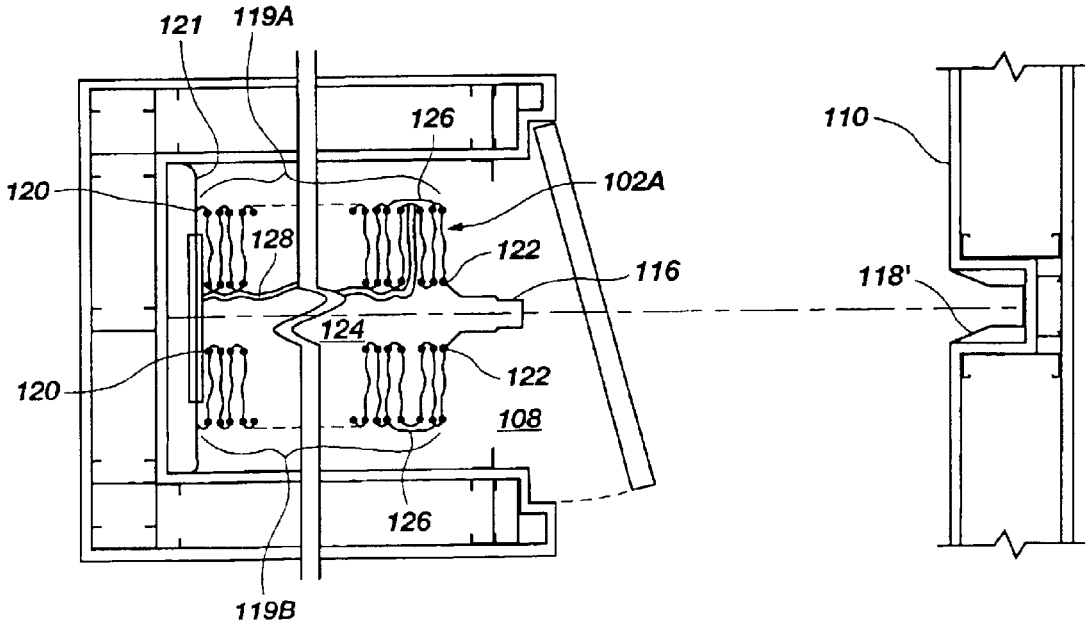
Fig. 3 (PRIOR ART)
FIG. 3 is a partial cross-sectional view of another embodiment of a prior art automatic door.
Figure 4:
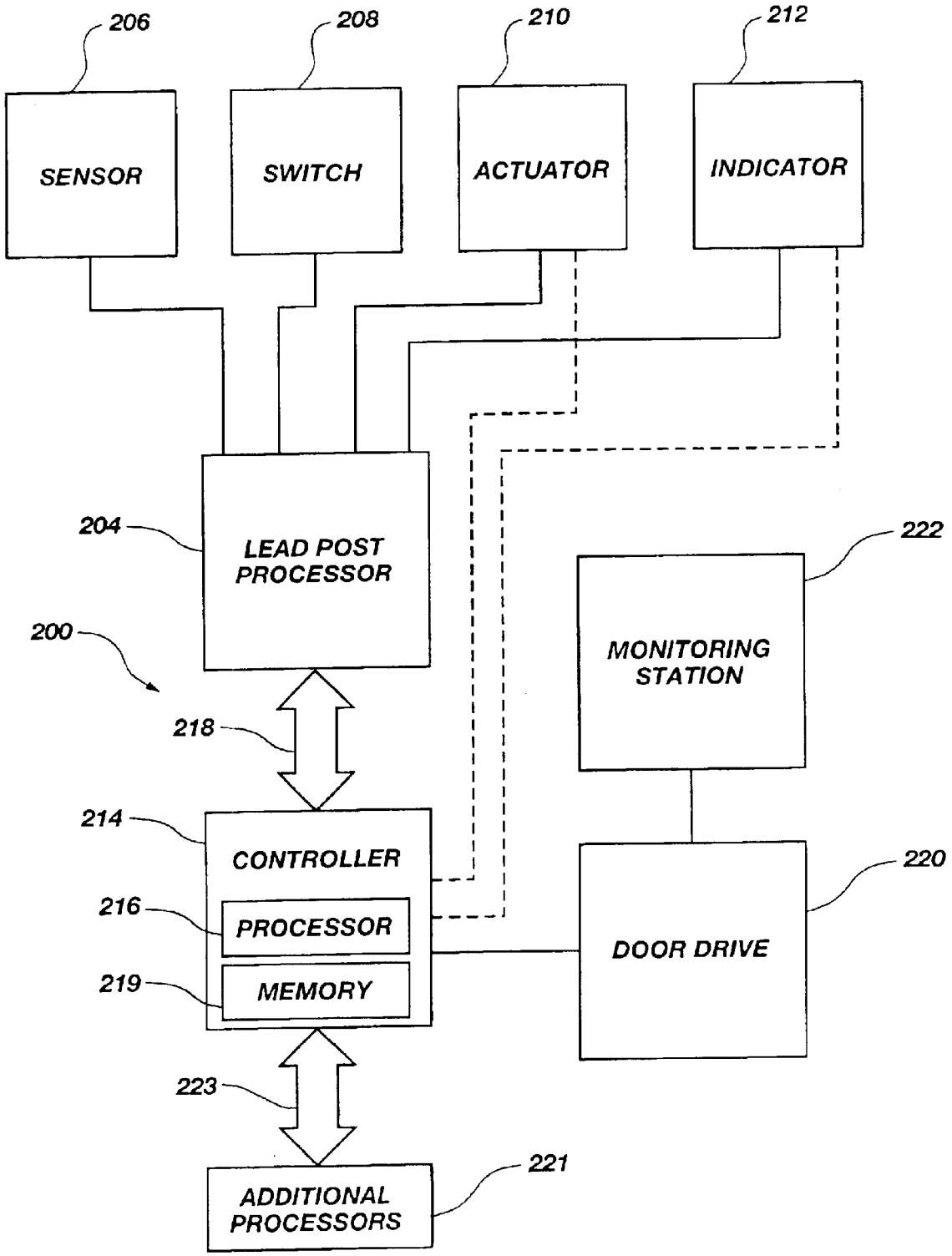
FIG. 4 is a schematic showing a control system associated with an automatic door according to an embodiment of the present invention.

Referring to FIG. 4, a control system 200 for an automatic door is shown. The control system 200 includes a first processor 204, also referred to herein as the lead post processor. As will be discussed in more detail below, the first processor 204 is installed adjacent a leading edge of the automatic door.

A plurality of input and output devices is operably coupled with the lead post processor 204. Such input and output devices may include, for example, sensors 206, switches 208, actuators 210 and indicators 212. More specific examples of such input and output devices may include: a sensor for detecting when the door is in a closed state; a sensor for detecting when an obstruction is in the path of the door while the door is closing; a switch or actuator used to stop the door from closing, or to open the door for a predetermined time period when already closed; an actuator causing a latch to lock the door in a closed position; a switch or actuator associated with security access (e.g., keyed entry or card readers); or indicators such as a horn or an LED display indicating the current status of the door.

The lead post processor 204 is in bi-directional communication with a controller 214 which includes a second processor 216 via a digital bus 218. The controller 214 may also include a memory device 219 for storing parameters associated with predetermined operations of the automatic door. The controller 214 is coupled with a drive 220 for controlling the position of the automatic door. The controller 214 may also be coupled with a monitoring station 222 which may be alerted by the controller 214 upon the occurrence of certain activities as reported by the various input devices to the controller 214 via the lead post processor 204. Additionally, the controller 214 may be coupled with additional processors 221 via a digital bus 223. For example, an additional processor 221 may be associated with the second lead post of a bi-part-style door. Alternatively, or in addition, a second processor may be associated with security access switches and/or actuators.

It is noted that, in implementation, the digital bus 218 connecting the lead post processor 204 with the controller 214 may cover lengths of several hundred feet or greater. It has been determined the present invention may be practiced with a digital bus 218 comprising electrical conductors extending up to at least 1,000 feet without a breakdown in communication between the lead post processor 204 and the controller 214.

Figure 5:
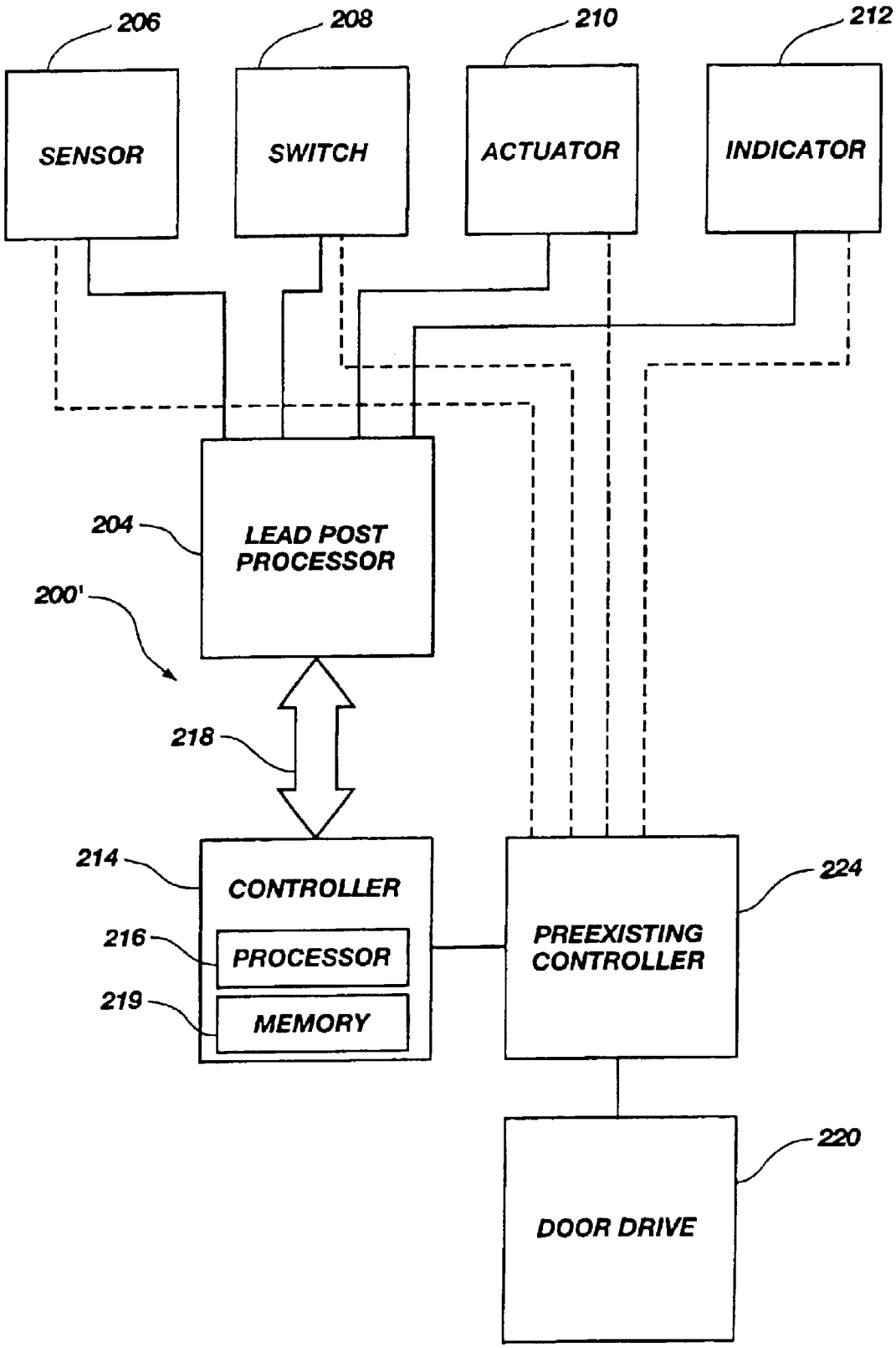
FIG. 5 is a schematic showing a control system associated with an automatic door according to another embodiment of the present invention.

Referring briefly to FIG. 5, an alternative embodiment of a control system 200' is shown. The control system 200' includes similar components as shown in FIG. 4, including the lead post processor 204, the input and output devices 206, 208, 210 and 212, the controller 214 and the drive 220. However, the control system 200' shown in FIG. 5 is adapted to a previously installed door including a preexisting control system. The control system 200' couples the controller 214 with the preexisting controller 224 which was previously directly wired to the individual input devices 206, 208, 210 and 212 as indicated by broken lines. Communication between the input and output devices 206, 208, 210 and 212 and the preexisting controller 224 is now rerouted via the lead post processor 204, the digital bus 218 and the new controller 214. The new controller 214 is configured to communicate with the preexisting controller 224 to control the position of the automatic door via its drive 220. While not shown in FIG. 5, either the new controller 214 or the preexisting controller 224 may also be coupled with a monitoring station in a similar manner as described above. Such a configuration may be desirable in retrofitting an existing automatic door with the control system of the present invention.

It is noted that, while it is desirable to couple the input devices (e.g., 206 and 208) with the lead post processor 204, it may be desirable in some instances to have the output devices (e.g., 210 and 212) coupled directly to the controller 214 or, alternatively, coupled with both the lead post processor 204 and the controller 214 for redundancy purposes. This will allow the controller to operate the output devices upon the occurrence of a failure of the digital bus 218 between the lead post processor 204 and the controller 214.

Figure 6:
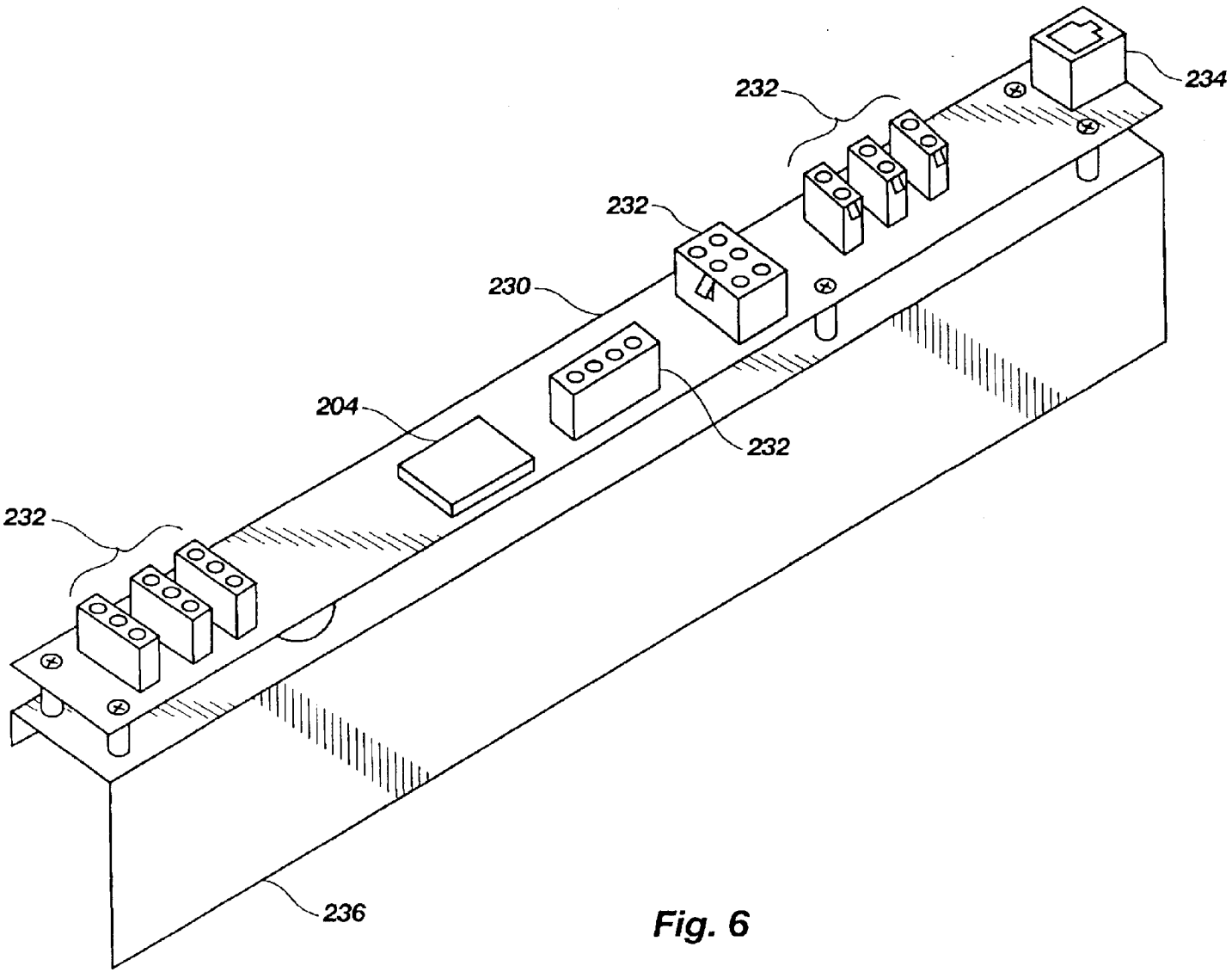
FIG. 6 is a perspective view of the circuit board utilized in the leading edge of an automatic door according to an embodiment of the present invention.

Referring now to FIG. 6, a circuit board 230 including the lead post processor 204 is shown. The circuit board 230 includes a number of connectors 232 for coupling the lead post processor 204 with various input and output devices 206, 208, 210 and 212 (FIG. 4). Another connector 234 is configured for coupling with the digital bus 218 (FIG. 4). The connector 234 for transmitting data via the digital bus may include, for example, an RJ45 communications/power connector as will be recognized by one of ordinary skill in the art. Such a connector 234 may be configured for coupling with a bus having multiple conductors, thereby accommodating the transmission of both power and data. The circuit board 230 is mounted to a bracket 236 which is configured for mounting within an automatic door proximate the leading edge thereof.

Figure 7:
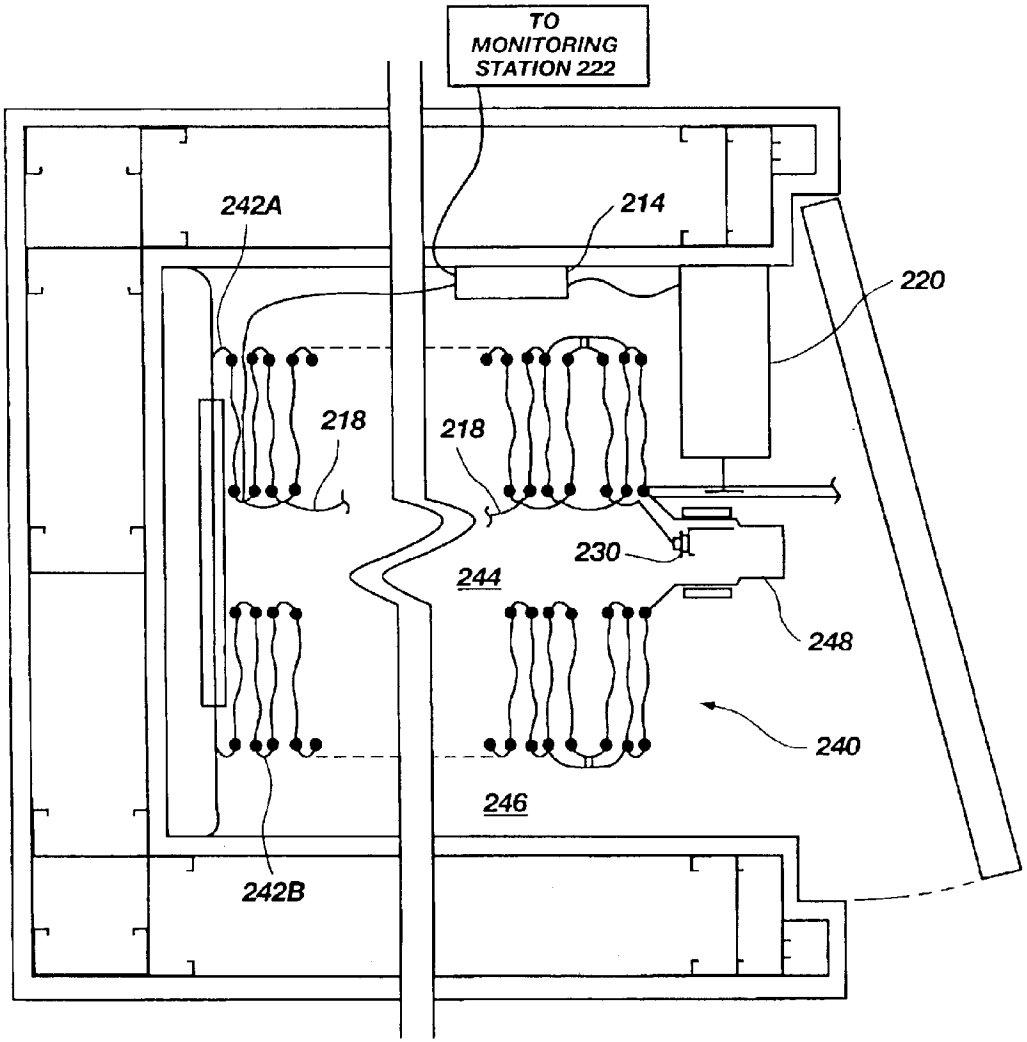
FIG. 7 is a partial cross-sectional view of an automatic door according to an embodiment of the present invention.

Referring now to FIG. 7, a partial cross-sectional view is shown of an exemplary automatic door 240 incorporating the control system 200 including the lead post processor 204. The automatic door 240 is shown as an accordion-style folding door which includes a first partition 242A and a second partition 242B. The second partition is laterally displaced from the first partition 242A, forming a space 244 therebetween. A leading edge, shown as a lead post 248, is coupled with both partitions 242A and 242B. It is noted that the door 240 is shown in a retracted position within its associated pocket 246.

Disposed within the lead post 248 is the circuit board 230 having the lead post processor 204 (FIG. 6) mounted thereon. The circuit board 230 is mounted by means of its associated bracket 236 and is configured to be moveable with the lead post 248 of the door 240. The controller 214 may be mounted within the pocket 246 and remains stationary relative to the door 240. The digital bus 218 is formed between the lead post processor 204 and the controller 214 and may include, for example, a set of conductors such as a telephone-type wire. In one embodiment, a telephone wire is used with the set of conductors, in this case four conductors, being connected to an RJ11-type connector at each end. However, the conductors need not be, and desirably aren't, reversed between the two RJ11 connectors as in a conventional telephone wire as will be understood by those of ordinary skill in the art. Using such a configuration, two conductors may be dedicated for data transfer or communications and two conductors may be dedicated for power.

It is noted that, while the digital bus 218 has been discussed primarily in terms of a set of conductors or wires, other embodiments of the digital bus 218 which are capable of transmitting digital data and, more particularly, capable of bi-directional communication, may be utilized. For example, the digital bus 218 may include wireless communication between the lead post processor 204 and the controller 214. Such wireless communication may include, for example, radio communication or the use of an optical beam. However, even if wireless communication between the lead post processor 204 and the controller 214 is implemented, one or more conductors may still extend between the lead post processor 204 and the controller for the purpose of providing power to the lead post processor 204 and to any input/output devices coupled therewith.

Figure 8:
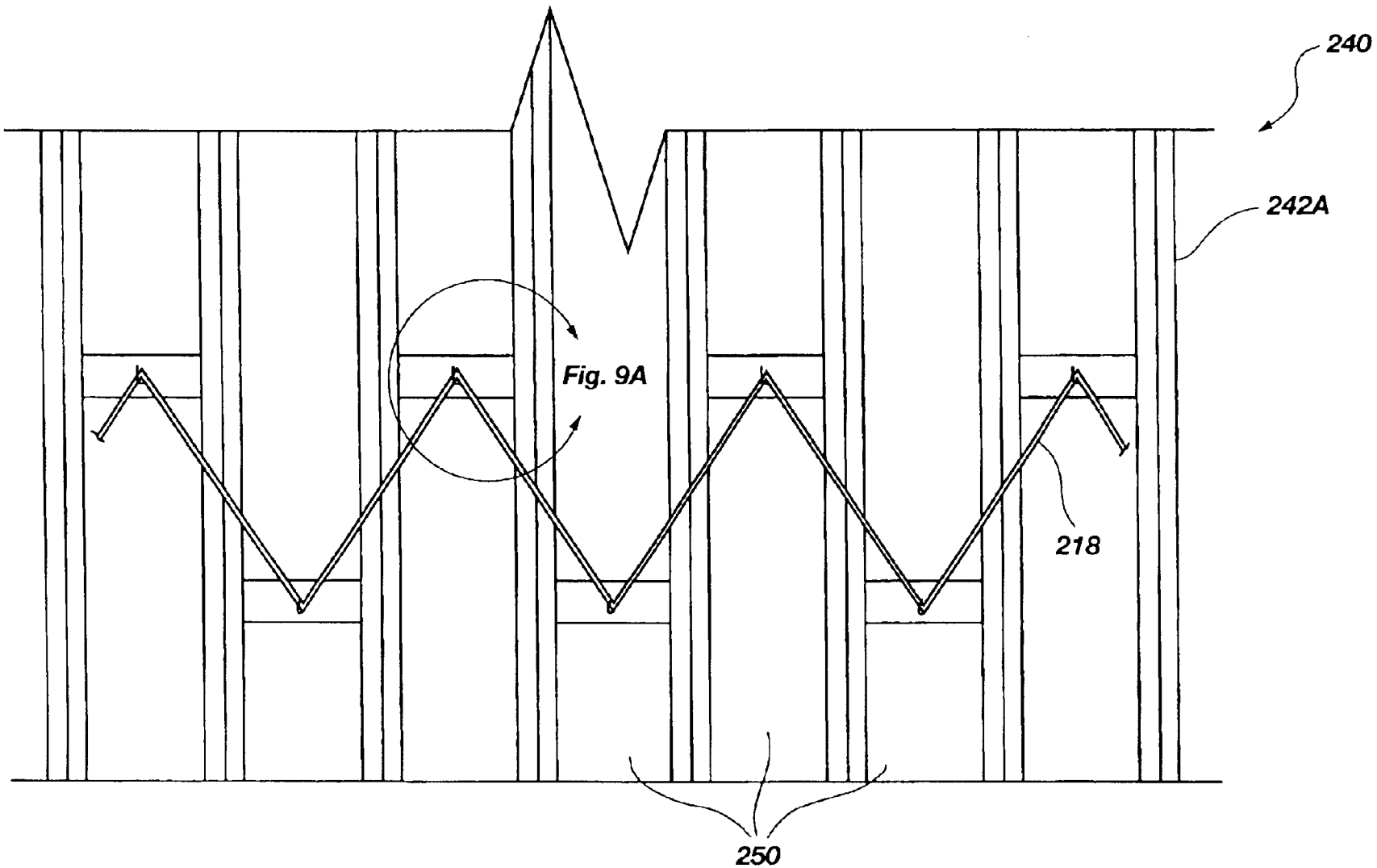
FIG. 8 is an elevational view of the interior portion of a partition of an automatic door according to an embodiment of the present invention.

Referring briefly to FIG. 8, an elevational view is shown depicting the interior portion of the first partition 242A. The digital bus 218 is attached to individual panels 250 at various locations such that the digital bus 218 has sufficient length to extend between the lead post processor 204 (not shown) and the controller 214 (not shown) when the door 240 is fully extended. As shown, the digital bus 218 may be attached to the panels 250 in an alternating or zig-zag-type pattern in order to minimize the amount of slack exhibited by the digital bus 218 when the door 240 is in a closed state. It is desirable to install the digital bus 218 such that there is not an overabundance of slack, or looping, between individual panels 250 in order to avoid crimping or kinking of the digital bus 218 during the opening and closing of the door. Further, in fire door applications, it may be desirable to install the digital bus 218 proximate the lower portion of the door 240 (e.g., closer to the floor) to potentially reduce its exposure to heat when the door 240 is exposed to an actual fire.

Figure 9A:
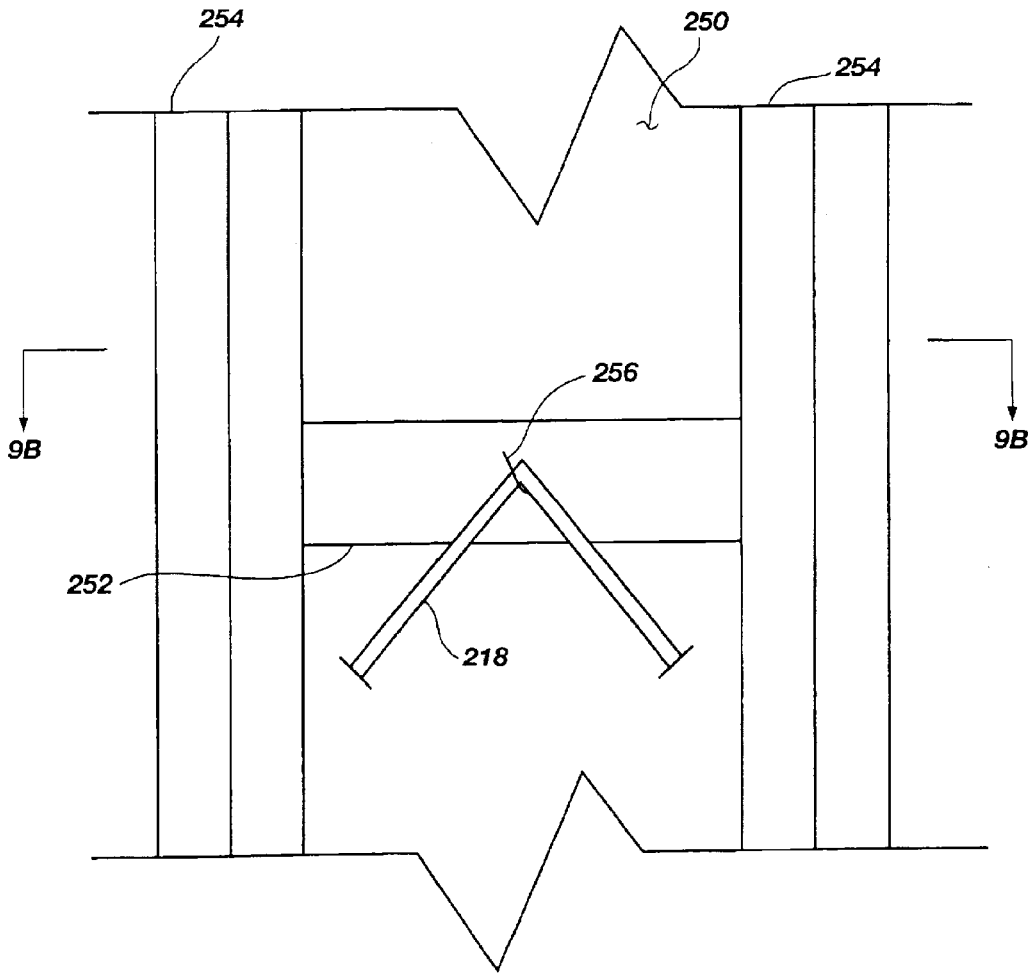
FIG. 9A is an enlarged view of a portion of the partition of FIG. 8.
Figure 9B:
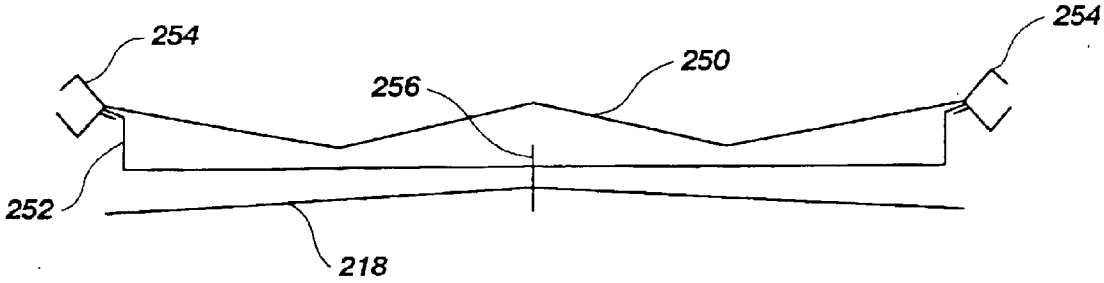
FIG. 9B is a sectional view taken along the lines indicated in FIG. 9A.

Referring now to FIGS. 9A and 9B, a portion of a panel 250 is shown in FIG. 9A as indicated in FIG. 8 and a sectional view of the same panel 250 is shown in FIG. 9B. A bracket member 252 is coupled between the hinge members 254 of the panel 250. A wire clip 256 is coupled to the bracket member 252 such as through an aperture formed therein. The wire clip 256 is configured to snugly, but releasably, hold the digital bus 218 and thereby affix a portion of the digital bus 218 to the bracket member 252.

Figure 10:
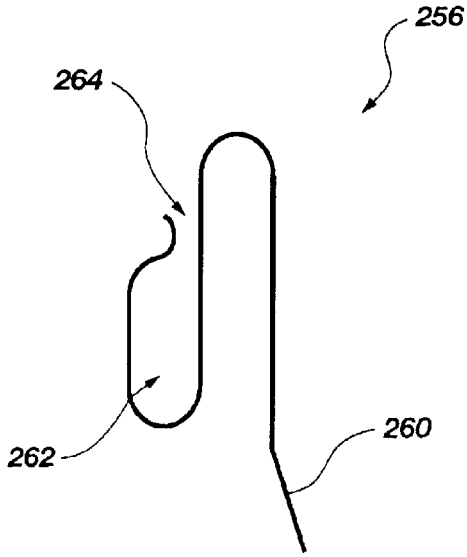
FIG. 10 shows a clip utilized in securing a bus within an automatic door according to an embodiment of the present invention.

An example of such a clip 256 is shown in FIG. 10. The clip 256 includes an angled portion 260 which accommodates installation of the clip 256 into an aperture of the bracket member 252. A retention portion 262 is sized and configured to house a portion of the digital bus 218 (e.g., a set of conductors such as a telephone-type wire). A constricted region 264 allows installation of the digital bus 218 into the retention portion 262 but is sized and configured such that the bus may not traverse therethrough without a predetermined amount of force, causing the clip to momentarily elastically deform. Such a clip may be formed, for example, of tempered steel or spring steel, thereby giving the clip adequate strength but allowing a desired amount of elastic deformation.

The use of a clip 256 to install the digital bus 218 allows for easier installation and removal of the digital bus 218 from the door 240. For example, one prior means of installing such a bus includes use of a plastic tie which is coupled to the bus and configured to "snap" into a corresponding bracket. However, if removal or replacement of the bus is ever required, such ties each need to be cut, both from the digital bus 218 and from the associated bracket. The wire clip 256 disclosed with the present invention allows removal of a digital bus 218 from the clip 256, allowing the clip to be reused with a newly installed bus.

Returning now to FIG. 7, the controller 214 is operably coupled with the drive 220 for the control thereof. The drive 220 is mechanically coupled with the door 240 by means of, for example, a gear and chain which displace the leading edge of the door 240. The controller 214 may also be in communication with a monitoring station 222 to indicate the status of the door 240 and to possibly receive operating instructions therefrom if so required. It is noted that the arrangement shown in FIG. 7 is illustrative and that the various components shown therein (e.g., the controller 214 and the drive 220) may be installed at various locations depending, for example, on site-specific installation requirements.

Figure 11:
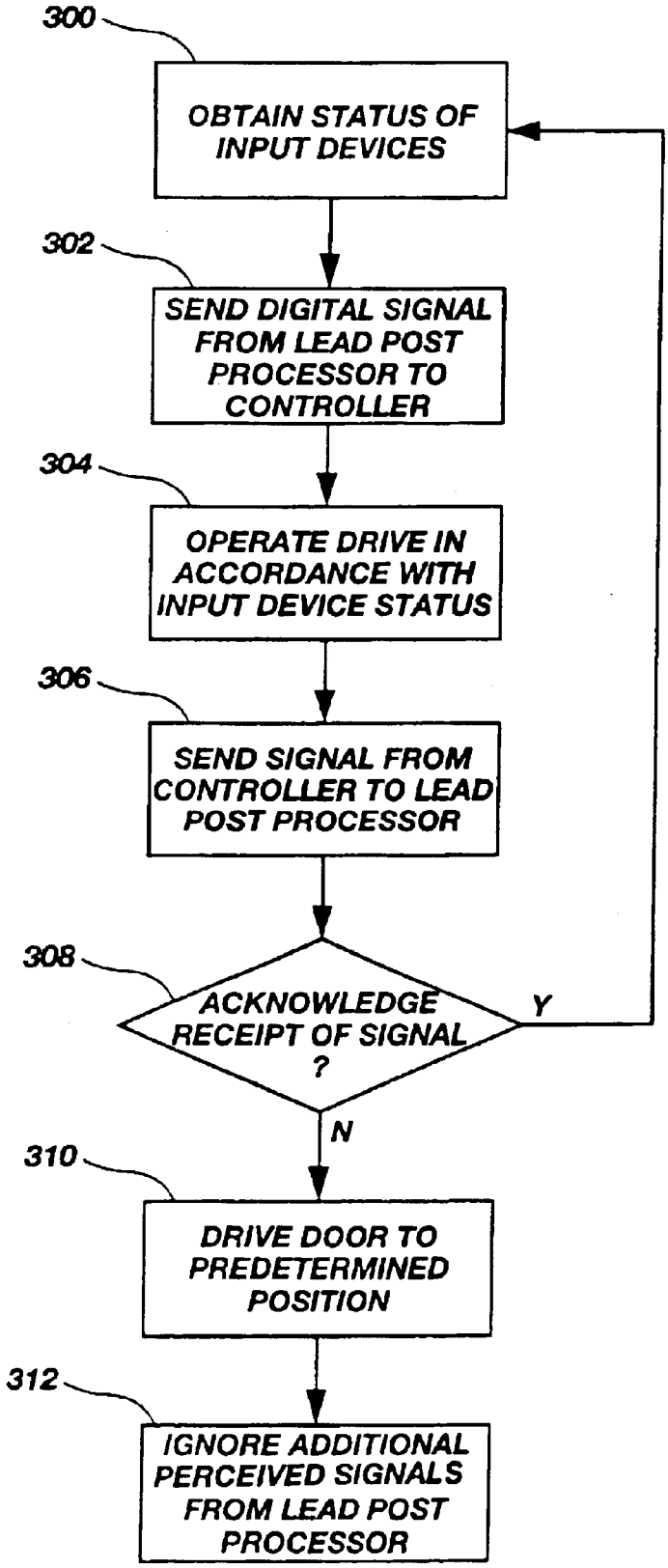
FIG. 11 is a flow diagram showing the logic of operating an automatic door according to an embodiment of the present invention.

Referring now to FIG. 11, an exemplary method of operating an automatic door 240 is described. The lead post processor obtains the status of one or more input devices as indicated at 300. As described above, the status of such input devices may indicate an obstruction in the path of the door, a request for the door to stop or open, etc. The lead post processor then sends a digitized signal representative of the input device's status through the bus to the controller as is indicated at 302. The controller processes the signal received from the lead post processor and operates the drive in accordance with the status of the input device as shown at 304. Thus, for example, if a request to open the door is sent from an input device, the controller may now cause the drive to open the door a predetermined distance for a predetermined amount of time.

Periodically, the controller may send a signal to the lead post processor to determine whether communication therebetween has been maintained as is indicated at 306. For example, during a fire, the bus may be subjected to extreme temperatures causing the failure thereof. Thus, it becomes desirable to determine whether communication between the controller and the lead post processor has been maintained.

As indicated at 308, the controller may wait for the lead post processor to acknowledge receipt of the signal. If acknowledgment is made, the door continues to function in the manner previously described. If, however, acknowledgment is not made, the controller assumes failure of communication between itself and the lead post processor and carries out one or more predetermined functions such as, for example, driving the door to a closed position as indicated at 310. Another predetermined function may include notifying the monitoring station of such a failure of communication.

It is noted that if the lead post processor fails to acknowledge receipt of a signal from the controller, the controller may, on its own initiative or upon instruction from a monitoring station, transmit one or more subsequent signals to confirm failure of communication therebetween.

After the door is placed in its predetermined position by the controller, the controller may be configured to ignore any subsequent perceived signals from the lead post processor as indicated at 312. By ignoring subsequent perceived signals, the controller is not influenced by erroneous signals produced by potential shorting within the bus. Thus, once a failure of communication between the lead post processor and the controller is established, the controller simply places the door in a predetermined status (which predetermined status may be stored in the memory device associated with the controller) in which the door remains.

While the invention may be susceptible to various modifications and alternative forms, specific embodiments have been shown by way of example in the drawings and have been described in detail herein. However, it should be understood that the invention is not intended to be limited to the particular forms disclosed. For example, while the exemplary embodiments have been generally described as an accordion-type door, the invention may be practiced with various types of doors wherein failure of a communication line between input devices and controllers may impair the operation of the door. Thus, it is to be understood that the invention includes all modifications, equivalents, and alternatives falling within the spirit and scope of the invention as defined by the following appended claims.

What is claimed is:

1. An actuator driven door comprising:

at least one movable partition;

at least one input device configured to generate a signal regarding an operational parameter of the at least one movable partition;

at least one processor operably coupled with the at least one input device;

at least another processor mutually remotely located from the at least one processor, a communication path coupled between the at least one processor and the at least another processor and configured to transmit data therebetween; and an actuator located and configured to displace the at least one movable partition responsive to a signal generated by the at least another processor.

2. The door of claim 1, wherein the communication path includes a wireless transmission between the at least one processor and that at least another processor.

3. The door of claim 1, wherein the communication path includes an optical beam.

4. The door of claim 1, wherein the communication path comprises a set of conductive wires.

5. The door of claim 1, wherein the at least one movable partition includes a first partition and a second partition, and wherein each of the first and second partitions include a plurality of panels laterally coupled to one another to enable folding thereof.

6. The door of claim 1, wherein the at least one movable partition is configured as a fire barrier.

7. The door of claim 1, further comprising at least one other input device operably coupled with the at least one processor.

8. The door of claim 7, wherein the at least one other input device comprises at least one of a switch and a sensor.

9. The automatic door of claim 1, further comprising a memory device operably associated with the at least another processor, the memory device including a set of parameters for controlling a position of a leading edge of the door responsive to data received by the at least another processor.

10. The automatic door of claim 1, further comprising a monitoring station operably coupled with the at least another processor.

11. A method of controlling a position of a door, the method comprising:

providing at least one processor at a first location and at least another processor at a second location mutually remote from the first location;

transmitting a first signal from the at least one processor to the at least another processor; and moving the door to a predetermined position upon failure to receive a return signal from the at least another processor responsive to the first signal.

12. The method according to claim 11, wherein the transmitting the first signal includes transmitting a wireless signal.

13. The method according to claim 11, wherein transmitting the first signal includes transmitting a signal as an optical beam.

14. The method according to claim 11, wherein transmitting the first signal includes transmitting a signal through at least one conductive wire.

15. The method according to claim 11, further comprising providing at least one input device, coupling the at least one input device to the at least one processor, and providing a status signal to the at least one processor from the at least one input device.

16. The method according to claim 15, further comprising relaying the status signal from the at least one processor to the at least another processor and positioning the door responsive to the status signal received by the at least another processor.

17. The method according to claim 11, further comprising ignoring subsequent perceived signals received by the at least another processor from the at least one processor after failure to receive the return signal from the at least one processor in response to the first signal.

* * * * *

UNITED STATES PATENT AND TRADEMARK OFFICE

CERTIFICATE OF CORRECTION

PATENT NO. : 7,066,297 B2
APPLICATION NO. : 10/703315
DATED : June 27, 2006
INVENTOR(S) : E. Carl Goodman et al.

It is certified that error appears in the above-identified patent and that said Letters Patent is hereby corrected as shown below:

COLUMN 5, LINE 16, change "input devices" to --input and output devices--

Signed and Sealed this

Sixteenth Day of December, 2008

JON W. DUDAS
*Director of the United States Patent and Trademark Office*